US006364066B1

(12) United States Patent
Bolch et al.

(10) Patent No.: US 6,364,066 B1
(45) Date of Patent: Apr. 2, 2002

(54) REMOTE RESCUE OF TRAPPED ELEVATOR PASSENGERS

(75) Inventors: James Richard Bolch, Avon; Joseph John Barna, Trumbull; Barry Graham Blackaby, West Simsbury, all of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/557,527

(22) Filed: Apr. 24, 2000

(51) Int. Cl.[7] ..... B66B 3/00
(52) U.S. Cl. ..... 187/391
(58) Field of Search ..... 187/391–393, 187/247, 414, 394

(56) References Cited

U.S. PATENT DOCUMENTS 3,973,648 A * 8/1976 Hummert et al. ..... 187/29 R
5,557,546 A * 9/1996 Fukai et al. ..... 187/391
5,736,694 A * 4/1998 Ketoviita ..... 187/391
6,000,505 A * 12/1999 Allen ..... 187/391

FOREIGN PATENT DOCUMENTS

JP 6016356 A * 6/1994
JP 406206674 A * 7/1994
JP 407172730 A * 7/1995
JP 8012214 A * 8/1996
JP 111335024 A * 11/1999

* cited by examiner

*Primary Examiner*—Jonathan Salata

(57) ABSTRACT

An elevator rescue system provides rescue signals from a remote control station. The rescue signals typically operate a release mechanism such as the brake to allow the elevator to move to an appropriate door zone. The rescue signals are preferably sent from a remote control station such as may typically monitor a number of elevators. Essentially, the rescue signal is initiated when the remote control station receives a signal from the elevator monitoring system that a particular elevator is likely to have trapped passengers. As an initial step, the remote control station ensures there is no safety reason not to move the elevator, and then remotely commands operation of an elevator component that allows the elevator cab to move.

10 Claims, 2 Drawing Sheets

REMOTE RESCUE OF TRAPPED ELEVATOR PASSENGERS

BACKGROUND OF THE INVENTION

This invention relates to a method and apparatus for performing a remote rescue operation of entrapped elevator passengers.

At various times in the operation of an elevator, passengers may become trapped. Most elevators are provided with a signaling device that will signal a maintenance person that passengers are trapped. Moreover, and more recently, elevators are provided with systems which communicate with a remote monitoring station. The remote monitoring station receives the signal and is able to communicate back to the trapped passengers to assure the passengers that assistance is on the way.

Presently, the methods of freeing trapped passengers occur at the elevator site. A maintenance worker at the elevator site is able to actuate a redundant rescue system, which is typically battery powered. The battery powered system is preferable since the cause of the passenger being trapped may be an electrical power failure in the building.

A redundant rescue system will typically initially determine whether the elevator can be moved safely. This would include checking the signals such as the signals from the safeties to ensure they have not been actuated. Safeties are devices mounted onto the elevator cab which stop cab movement should the cab be moving in an unsafe fashion. As an example, the safeties are actuated if the elevator is moving at too great a speed. Another safety condition which is monitored prior to operation of the redundant rescue system is whether the elevator cab doors are open. It sometimes may not be safe to move the elevator if the cab doors are opened.

If a determination is made that there is no safety reasons not to move the cab, then the maintenance worker is able to actuate the redundant rescue system to allow movement of the cab. Typically, a brake for controlling cab movement upwardly and downwardly is released to allow the cab to move to the next door zone. Other elevators are not provided with a redundant rescue system, but instead have the ability to manually actuate the brake and allow the elevator to move to the next door zone.

It would be desirable to allow the rescue of trapped passengers from a remote location. First, if the passengers are trapped where there are no experienced maintenance personnel, it may require that an experienced maintenance personnel be sent to the location. This can be inconvenient for the trapped passengers, as some period of time could elapse. Moreover, if the passengers are trapped at a non-office hour, it may also be inconvenient to find a maintenance person, and have him travel to the location of the elevator.

SUMMARY OF THE INVENTION

In a disclosed embodiment of this invention, a remote control monitors operation of an elevator cab, and determine whether a trapped condition exists. If so, the remote control is able to actuate a rescue system, such as the brake, remotely. The control monitors movement of the cab, and stops the cab at an adjacent door zone.

In a preferred embodiment of this invention, the remote control is also provided with signals of the current condition of the elevator. In particular, signals relative to safety condition are forwarded to the remote control. The remote control ensures there is no safety reason not to move the elevator prior to remotely ordering a rescue operation.

Preferably,signals from the elevator cab safeties, and a cab door status signal are sent to the remote control. If the remote control determines there is a safety reason not to allow the elevator to move, the elevator will not be actuated remotely. However, if no safety reason appears, then the elevator is actuated remotely and moved to the next door zone. The basic structure for performing this remote rescue is already a part of the overall elevator control. A signaling control from the remote control to the elevator must be added. A control at the elevator must be capable to receive the remote signal and actuate the brake, or other rescue system, to allow the elevator to move to the next door zone.

The remote control may be at a remote monitoring station. Alternatively, the remote control could be a maintenance worker who sends in the signal remotely, such as over a telephone keypad.

These and other features of the present invention can be best understood from the following specification and drawings, the following of which is a brief description.

DETAILED DESCRIPTION OF A PREFERRED EMBODIMENT

Figure 1:
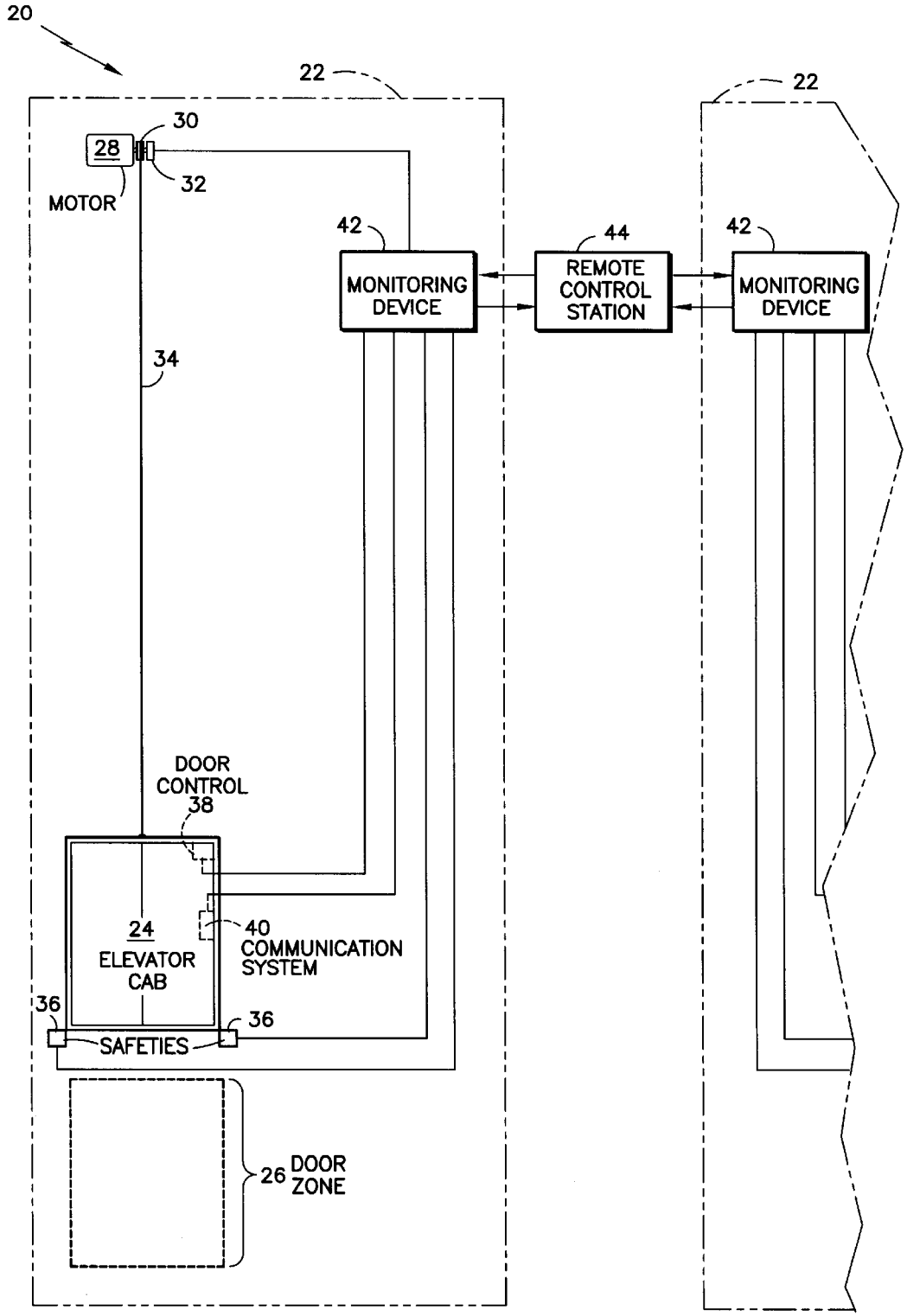
FIG. 1 is a schematic view of a first embodiment of this invention.

An elevator and remote rescue system 20 is illustrated in FIG. 1. A building 22 is shown in phantom receiving an elevator cab 24. The elevator cab is illustrated stopped at a location not aligned with the most adjacent door zone 26.

A motor 28 which operates to drive a pulley sheave 30, and move the cab 24, is also provided with a brake 32. As known, a cable 34 is driven by sheave 28 to move cab 34 These portions of the invention are shown extremely schematically, and may all be as known in the art. While the brake is shown on the pulley 30, it is also known that elevator brakes may be associated with other areas in system 20. The other brake locations also come within the scope of this invention.

The elevator cab 24 is provided with safeties 36. As known, safeties 36 are actuated when improper travel of the elevator cab 24 is detected. As an example, if the elevator cab 24 moves at too high a rate of speed, the safeties 36 are actuated to prevent further movement of the elevator cab 24. A door open control 38 is also shown schematically. The door open control 38 is operable to automatically open the cab doors, and further to provide a feedback signal of whether the cab doors are open.

An elevator passenger communication system 40 is also shown schematically. As is known, the system 40 can be as simple as a help button, or as complex as a video communication signal providing both video and audio two-way communication. The signals from the components 32, 36, 38 and 40 all travel to an elevator monitoring device 42. The monitoring device 42 is shown also as a control for components on the elevator. As is known, the monitoring device 42 communicates with a remote control station 44. In modern elevator operation, remote monitoring stations receive distress calls from several elevators over a large geographic area. In this embodiment, the remote monitoring station also operates as a remote control station 44. Further, the monitoring device 42 can also monitor movement of the cab. If the remote control station 44 receives a distress call from the passenger communication signal 40, then it determines that the elevator has trapped passengers. Also, if the elevator should be moving, as identified by the monitoring device 42 and it is not, the remote control station 44 can make a determination that perhaps passengers are trapped within the elevator. As shown in FIG. 1, remote control station 44 may communicate with a plurality of elevators 20 associated with a plurality of distinct buildings 22. The term "remote" as utilized in this application extends not only to a remote control station 44 mounted in a building distinct from the buildings which house the elevators, but further to remote control stations located within the same building as an elevator, but remote from the particular elevators. That is, in a very large building, a monitoring station could be spaced from the location of the elevators and could control rescue operations in a number of different elevators at different locations within the building.

In the past, the remote monitoring station was able to communicate to the monitoring system 42, and provide two-way audio communication to the passenger signaling device 40. However, the remote monitoring station has not controlled operation of the elevator 20 to achieve a rescue in the past.

In the present invention, the remote control station 44 is operable to control the elevator and move a stopped cab to an adjacent door zone 26. As shown in the drawing, the monitoring device 42 is connected to actuate the brake 32 and release the brake upon appropriate signals.

Thus, if the remote control station 44 receives a signal that there are trapped passengers, the next step is to determine whether the elevator cab 24 can be moved safely. This includes monitoring whether the safeties 36 are actuated and whether the door open sensor 38 indicates the door is open. Other appropriate safety signals can also be monitored.

If there is no safety reason not to actuate the cab, then the remote control station 44 directs monitoring device 42 to release brake 32 and allow the motor 28 to move the cab 24 to an adjacent door zone 26. Known feedback of the actual position of the cab 24 is also included such that the cab 24 is stopped at the appropriate door zone 26. This portion of the invention is well within the skill of a worker in this art. It is the remote control of the rescue device, here shown as the brake 32, which is inventive. Moreover, once at the door zone 26, the remote control 44 actuates the door open control 38 to automatically open the doors.

If the elevator does not provide automatic door opening, then a voice communication to the trapped passengers over communication system 40 may indicate to the passengers that they will have to manually open the cab doors.

Figure 2:
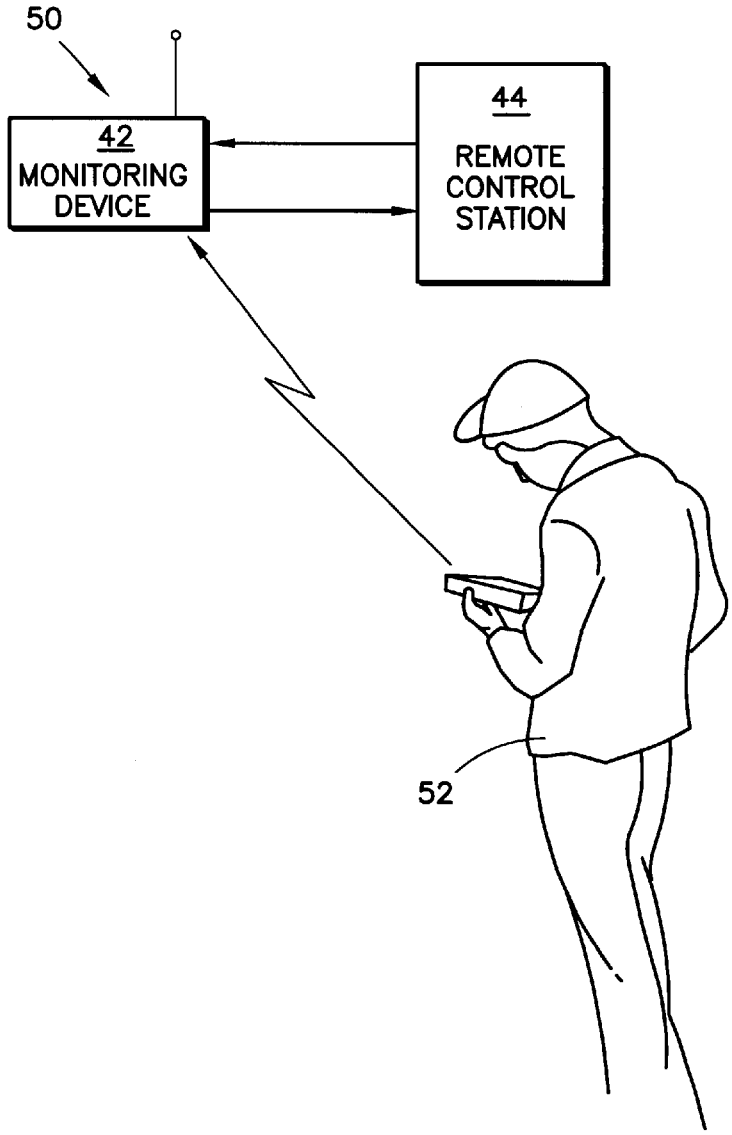
FIG. 2 is a schematic view of a second embodiment of this invention.

FIG. 2 shows another embodiment of the present invention wherein the remote control station includes an operator 52 remotely commanding the monitoring system 42 to perform the rescue. The operator 52 can send signals into the monitoring system 42 in any fashion, including entering the signals over a telephone handset. The technology to send appropriate signals over telephone lines is known. It is the application of this technology to command a remote elevator rescue which is inventive here. In this embodiment, station 44 can still provide the monitoring step, and send an appropriate signal to operator 52 that a rescue is necessary.

Figure 3:
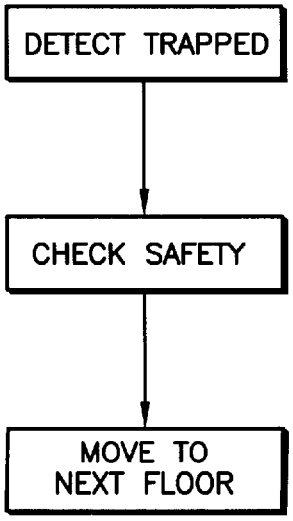
FIG. 3 is a basic flow chart for this invention.

The flow chart of FIG. 3 briefly describes this invention. As shown, a trapped passenger situation is initially detected. The next control step is to determine whether there is any safety reasons not to move the elevator cab. If no safety reasons are determined, then a signal is sent from a remote location to release the elevator cab for movement to a door zone. Once at the door zone, the passengers are released.

Although the monitoring device 42 is shown both controlling and monitoring, it should be understood that two separate controls could be utilized with the first monitoring operation of the cab and sending information to the control station 44, and a second component receiving control instructions and controlling operation of the components, such as brake 32. For purposes of this application such a two-part system would meet the limitation of the "elevator monitoring system" as disclosed, claimed and shown in the schematic FIGS. 1 or 2.

Although preferred embodiments of this invention have been disclosed, a worker in this art would recognize that modifications do come within the scope of this invention. For that reason, the following claims should be studied to determine the true scope and content of this invention.

What is claimed is:

1. A system comprising:

an elevator cab provided with a mechanism for moving said cab vertically, and a mechanism for stopping movement of said cab;

an elevator monitoring device associated with said cab and receiving signals relative to operational conditions of said cab, and providing component control signals to at least one component on said elevator to allow said cab to move; and a remote control station, remote from said elevator monitoring device and said cab, said remote control station operable to receive said signals from said elevator monitor and feedback signals from said cab indicating passengers may be trapped in said cab, and said remote control station being operable to send a remote control signal to said elevator monitoring device to actuate said at least one component and control the movement of said cab to cause said cab to move to an adjacent door zone and allow rescue of any trapped passenger from said cab.

2. A system as recited in claim 1, wherein said remote control station communicates with a plurality of local elevator monitoring devices.

3. A system as set forth in claim 1, wherein said remote control station is located in a distinct building from said cab.

4. A system as recited in claim 1, wherein said remote control station actuates a brake for said elevator to allow said cab to move.

5. A system as recited in claim 4, wherein said control only actuates said brake after a determination is made that said elevator cab can be moved safely.

6. A system as set forth in claim 1, wherein said remote control station includes a signal sent by an operator over a telephone handset.

7. A method of rescuing a trapped elevator passenger comprising the steps of:

(1) providing an elevator cab having a monitoring system for receiving feedback of operational conditions of said cab, and for controlling aspects of said elevator, including a mechanism for stopping and allowing movement of said elevator;

(2) monitoring operation of said cab, and determining when a cab has been improperly stopped, and communicating a signal to a remote control station that an elevator cab has been improperly stopped; and (3) actuating a remote rescue system from said remote control station to control said elevator cab from a remote location to move to said elevator cab to an adjacent door zone.

8. A method as set forth in claim 7, wherein said remote control station includes an operator sending said signal of step (2) over a telephone handset.

9. A method as recited in claim 7, wherein said signal which is communicated in step (2) is communicated by a remote control station which also makes the determination of step (2).

10. A system comprising:

an elevator cab provided with a mechanism for moving said cab vertically, and a mechanism for stopping movement of said cab;

an elevator monitoring device associated with said cab and receiving signals relative to operational conditions of said cab, and providing component control signals to at least one component on said elevator to allow said cab to move; and a remote control station, remote from said elevator monitoring device and said cab, said remote control station operable to receive feedback signals from said cab indicating the passengers may be trapped in said cab, and said signals from said elevator monitoring device and said remote control station being operable to send a remote control signal to said elevator monitoring device to cause said elevator monitoring device to operate a brake to move said cab to an adjacent door zone and allow rescue of any trapped passenger from the cab, said remote control station located in building distinct from said cab, and communicating with a plurality of elevator monitoring devices located in distinct buildings.

* * * * *